US012467452B2

(12) United States Patent
Kikuchi

(10) Patent No.: US 12,467,452 B2
(45) Date of Patent: Nov. 11, 2025

(54) MOUNTING STRUCTURE FOR DIAPHRAGM AND RETAINER

(71) Applicant: IWAKI CO., LTD., Tokyo (JP)
(72) Inventor: Masaki Kikuchi, Iruma-gun (JP)
(73) Assignee: IWAKI CO., LTD., Tokyo (JP)

( * ) Notice: Subject to any disclaimer, the term of this patent is extended or adjusted under 35 U.S.C. 154(b) by 0 days.

(21) Appl. No.: 18/835,572
(22) PCT Filed: Dec. 27, 2022
(86) PCT No.: PCT/JP2022/048099
§ 371 (c)(1),
(2) Date: Aug. 2, 2024
(87) PCT Pub. No.: WO2023/149137
PCT Pub. Date: Aug. 10, 2023
(65) Prior Publication Data
US 2025/0154947 A1 May 15, 2025
(30) Foreign Application Priority Data
Feb. 4, 2022 (JP) ..... 2022-016444
(51) Int. Cl.
*F04B 53/00* (2006.01)
*F04B 43/02* (2006.01)
(52) U.S. Cl.
CPC ..... *F04B 53/00* (2013.01); *F04B 43/02* (2013.01)
(58) Field of Classification Search
CPC ..... F04B 43/02; F04B 43/0054; F04B 53/00
See application file for complete search history.

(56) References Cited

U.S. PATENT DOCUMENTS 5,466,133 A * 11/1995 Tuck, Jr. ..... F04B 43/0054 417/474
5,529,468 A 6/1996 Tuck, Jr.
(Continued)

FOREIGN PATENT DOCUMENTS

DE 10 2014 006 503 B4 10/2021
JP S34-10585 B1 12/1959
(Continued)

OTHER PUBLICATIONS

Feb. 7, 2023 International Search Report issued in International Patent Application No. PCT/JP2022/048099.
(Continued)

*Primary Examiner* — Thomas E Lazo
(74) *Attorney, Agent, or Firm* — Oliff PLC

(57) ABSTRACT

A mounting structure for a diaphragm and a retainer includes: the diaphragm that is formed to have a disc shape and includes a fixation part positioned in an outer circumferential part of the diaphragm, a movable part positioned in a central part of the diaphragm, and a linking part linking the fixation part and the movable part together, wherein a side of the diaphragm facing a pump chamber is defined as a front side and a side of the diaphragm opposite from the pump chamber is defined as a rear side; and the retainer that has an annular shape, supports the rear side of the movable part of the diaphragm, and reciprocates, together with the movable part, in an advancement/retreat direction to and from the pump chamber. The diaphragm has a first R-shaped part recessed toward the pump chamber, on the rear side of a boundary section between the movable part and the linking part. The retainer includes an abutment part that abuts against the rear side of the diaphragm and a second R-shaped part that is formed in an outer circumferential position of the abutment part so as to protrude toward the pump chamber and that mates with the first R-shaped part.

12 Claims, 5 Drawing Sheets

(56) References Cited

U.S. PATENT DOCUMENTS

| | | | | |
|---|---|---|---|---|
| 5,676,531 | A * | 10/1997 | Muscarella | F04B 53/147 417/413.1 |
| 6,302,660 | B1 | 10/2001 | Kurita et al. | |
| 6,758,657 | B1 * | 7/2004 | McNaull | F04B 43/04 417/415 |
| 2011/0091340 | A1 * | 4/2011 | Sunagawa | F04B 53/1077 417/559 |

FOREIGN PATENT DOCUMENTS

| | | | |
|---|---|---|---|
| JP | S54-046924 | U | 3/1979 |
| JP | H10-502153 | A | 2/1998 |
| JP | 2001-123960 | A | 5/2001 |
| JP | 2005-264795 | A | 9/2005 |
| JP | 2017-106325 | A | 6/2017 |

OTHER PUBLICATIONS

Aug. 6, 2024 International Preliminary Report on Patentability issued in International Patent Application No. PCT/JP2022/048099.
k.
Nov. 15, 2024 extended Search Report issued in European Patent Application No. 22925039.4.

* cited by examiner

B-B CROSS-SECTION

MOUNTING STRUCTURE FOR DIAPHRAGM AND RETAINER

TECHNICAL FIELD

The present invention relates to a mounting structure for a diaphragm and a retainer.

BACKGROUND ART

A pump device using a diaphragm as a reciprocating member (see Patent Literature 1, for example) is known. In the device, the diaphragm is structured so as to include a movable part being thick and positioned in a central part, a fixation part positioned in an outer circumferential part of the movable part, and a linking part linking the movable part and the fixation part together. Further, a drive shaft is attached to the rear side of the diaphragm via a retainer serving as a pressing member that supports the diaphragm. The retainer includes a pressing section that supports the movable part of the diaphragm with a flat surface; and a membrane receiving section shaped so as to be spliceable with the linking part, while retreating from the pressing section toward the drive shaft.

CITATION LIST

Patent Literature

Patent Literature 1:
Japanese Patent Laid-Open No. 2017-106325

SUMMARY OF INVENTION

Technical Problem

However, in the diaphragm according to the conventional technique disclosed in Patent Literature 1 listed above, the linking part is greatly deformed in the range from a top dead center position to a bottom dead center position of reciprocation of the drive shaft, and a contact range between the diaphragm and the retainer also changes. For this reason, even though the membrane receiving section of the retainer supports the linking part, the diaphragm is deformed in such a manner that the more a high pressure load is applied, the more outwardly strain escapes.

That means, for example, an effective diameter of a pump device will change, the effective diameter denoting a diameter that defines the area of a part that actually presses fluid to be transported (hereinafter, "transport fluid"). In addition, because the strain is easily transferred from a boundary section between the movable part and the linking part, i.e., a central part, to a movable section, and stress concentration may thus easily occur.

Further, when the diaphragm and the retainer structured as described above are applied to a pump device, in particular, a problem arises in that, as the deformation amount of the diaphragm increases, discharge amounts of the pump device may be unstable. Another problem is that, when the effective diameter changes, the discharge amounts greatly fluctuate. Furthermore, there is yet another problem in that, when stress concentration occurs, the part affected thereby becomes deteriorated and can easily be damaged.

The present invention has been made in consideration of the above circumstances, and has an object to provide a mounting structure for a diaphragm and a retainer capable of securing a stable discharge amount of a pump device and a prolonged life cycle of the diaphragm.

Solution to Problem

A mounting structure for a diaphragm and a retainer according to an aspect of the present invention includes: the diaphragm that is formed to have a disc shape and includes a fixation part positioned in an outer circumferential part of the diaphragm, a movable part positioned in a central part of the diaphragm, and a linking part linking the fixation part and the movable part together, wherein a side of the diaphragm facing a pump chamber is defined as a front side and a side of the diaphragm opposite from the pump chamber is defined as a rear side; and the retainer that has an annular shape, supports the rear side of the movable part of the diaphragm, and reciprocates, together with the movable part, in an advancement/retreat direction to and from the pump chamber. The diaphragm has a first R-shaped part recessed toward the pump chamber, on the rear side of a boundary section between the movable part and the linking part; and the retainer includes an abutment part that abuts against the rear side of the diaphragm and a second R-shaped part that is formed in an outer circumferential position of the abutment part so as to protrude more toward the pump chamber relative to the abutment part and that mates with the first R-shaped part.

In an embodiment of the present invention, when the movable part of the diaphragm moves farthest toward the pump chamber so as to be at a top dead center position, an apex part of the second R-shaped part of the retainer is positioned closer to the pump chamber relative to a surface of the diaphragm on a rear side of the fixation part.

In another embodiment of the present invention, the diaphragm and the retainer are attached in such a manner that at least sections of the first R-shaped part and the second R-shaped part that are positioned radially inward from apex parts of the first R-shaped part and the second R-shaped part are in contact with each other during reciprocation of the diaphragm.

In yet another embodiment of the present invention, the pump chamber is provided in a pump head; the pump head has a first sandwiching surface on the diaphragm side; a bracket having a second sandwiching surface opposing the first sandwiching surface of the pump head is provided; the fixation part of the diaphragm is sandwiched and held between the first sandwiching surface of the pump head and the second sandwiching surface of the bracket; the diaphragm further has, on an outer circumferential rim of the fixation part, a seal part that is thicker than an inside of the outer circumferential rim and is elastically deformable; formed on an outer circumferential side of the first sandwiching surface of the pump head is a first pressing surface recessed from the first sandwiching surface; formed on an outer circumferential side of the second sandwiching surface of the bracket is a second pressing surface recessed from the second sandwiching surface; and the seal part is pressed and held between the first pressing surface and the second pressing surface.

In yet another embodiment of the present invention, the diaphragm and the retainer are attached in such a manner that, when the diaphragm either is in a neutral position between the top dead center position and a bottom dead center position or is closer to the top dead center position relative to the neutral position, the first R-shaped part and the second R-shaped part are in contact with each other.

In yet another embodiment of the present invention, provided is a movable shaft that has an insert member attached at a tip end of the movable shaft and that drives the movable part to reciprocate in the axial direction while a tip end part of the insert member is inserted in the movable part of the diaphragm. The retainer is attached to the tip end of the movable shaft coaxially with the movable shaft; and a part of the movable part of the diaphragm is sandwiched and held between an inner circumferential part of the second R-shaped part and the abutment part of the retainer and the tip end part of the insert member.

In yet another embodiment of the present invention, a diameter of the tip end part of the insert member is equal to or larger than an inside diameter of the abutment part of the retainer and is equal to or smaller than a diameter of the apex part of the second R-shaped part.

Advantageous Effects of Invention

According to the present invention, it is possible to realize a stable discharge amount of the pump device and a prolonged life cycle of the diaphragm.

DESCRIPTION OF EMBODIMENTS

Figure 1:
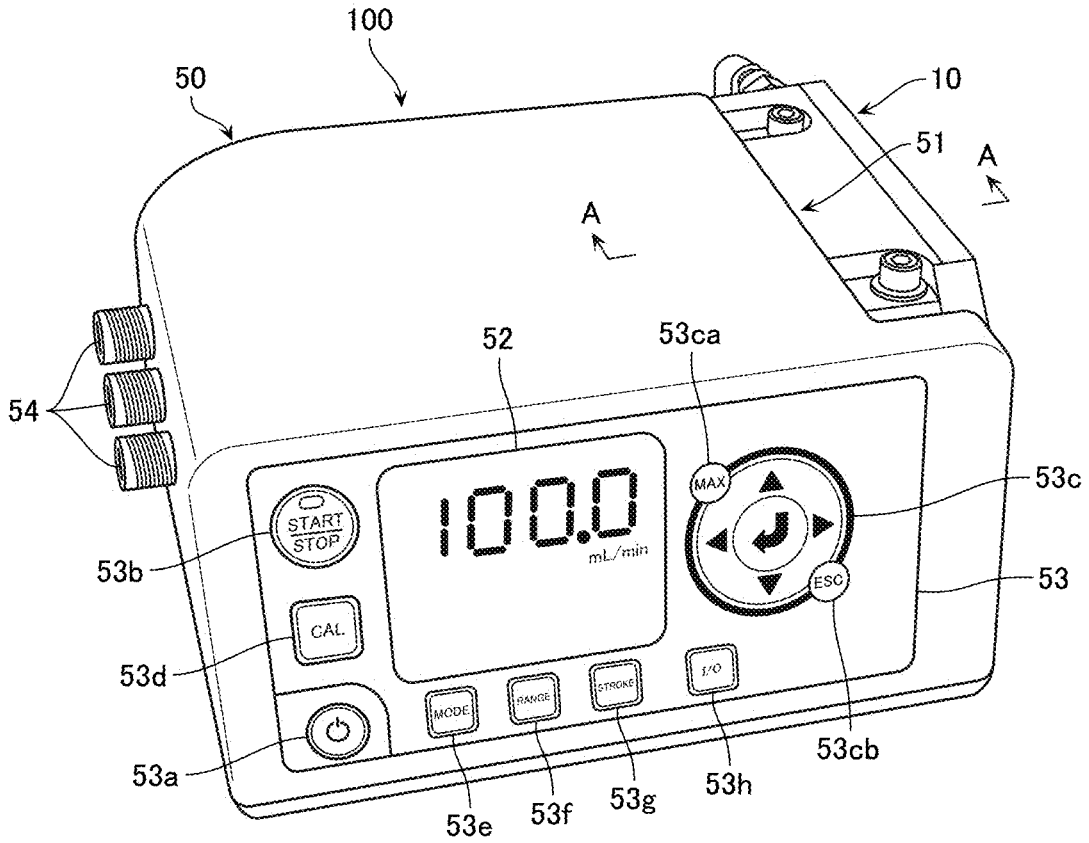
FIG. 1 is a perspective view showing an exterior configuration of a pump device to which a mounting structure for a diaphragm and a retainer of an embodiment of the present invention is applied.

The following will describe a mounting structure for a diaphragm and a retainer according to embodiments of the present invention in detail, with reference to the accompanying drawings. It should be noted that the following embodiments are not intended to limit the invention set forth in the claims. Also, not all the combinations of the features described in the embodiments are necessarily requisite for the means for solving the problems of the invention. In addition, in the following embodiments, some of the constituent elements that are the same as or correspond to each other will be referred to by using the same reference characters, and duplicate explanations thereof will be omitted. Furthermore, in the embodiments, the positional arrangements, scales, and dimensions of the constituent elements may be exaggerated or diminished and presented differently from those in reality, and some of the constituent elements may be omitted from the presentation.

[A Configuration of a Pump Device]

Figure 2:
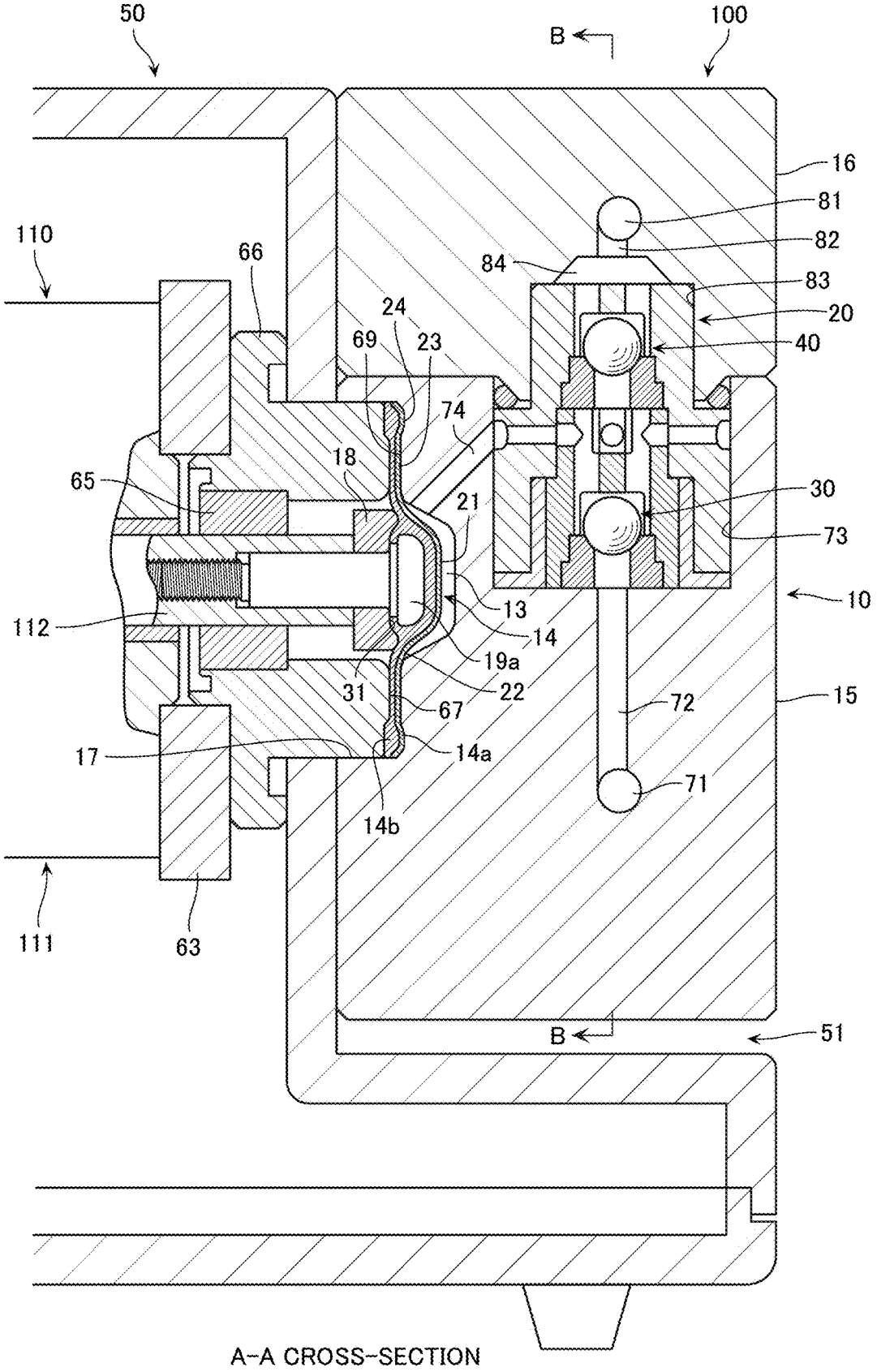
FIG. 2 is a cross-sectional view taken at the line A-A in FIG. 1.
Figure 3:
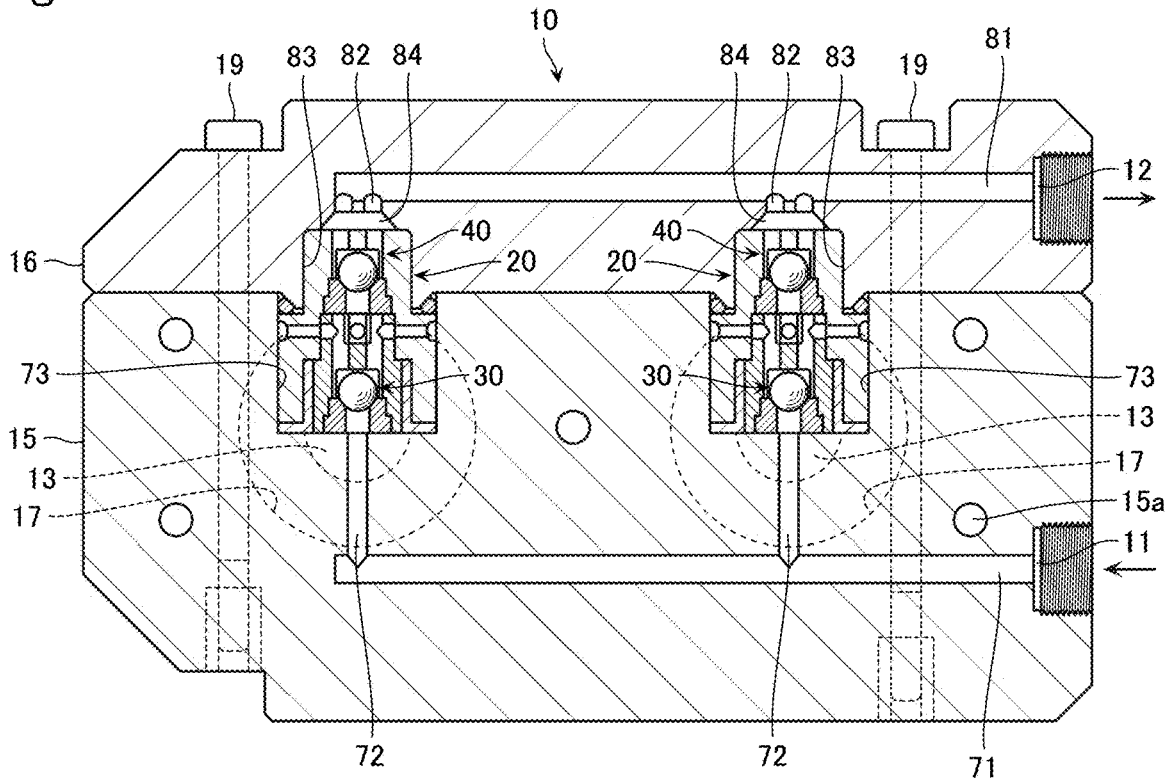
FIG. 3 is a cross-sectional view taken at the line B-B in FIG. 2.
Figure 4:
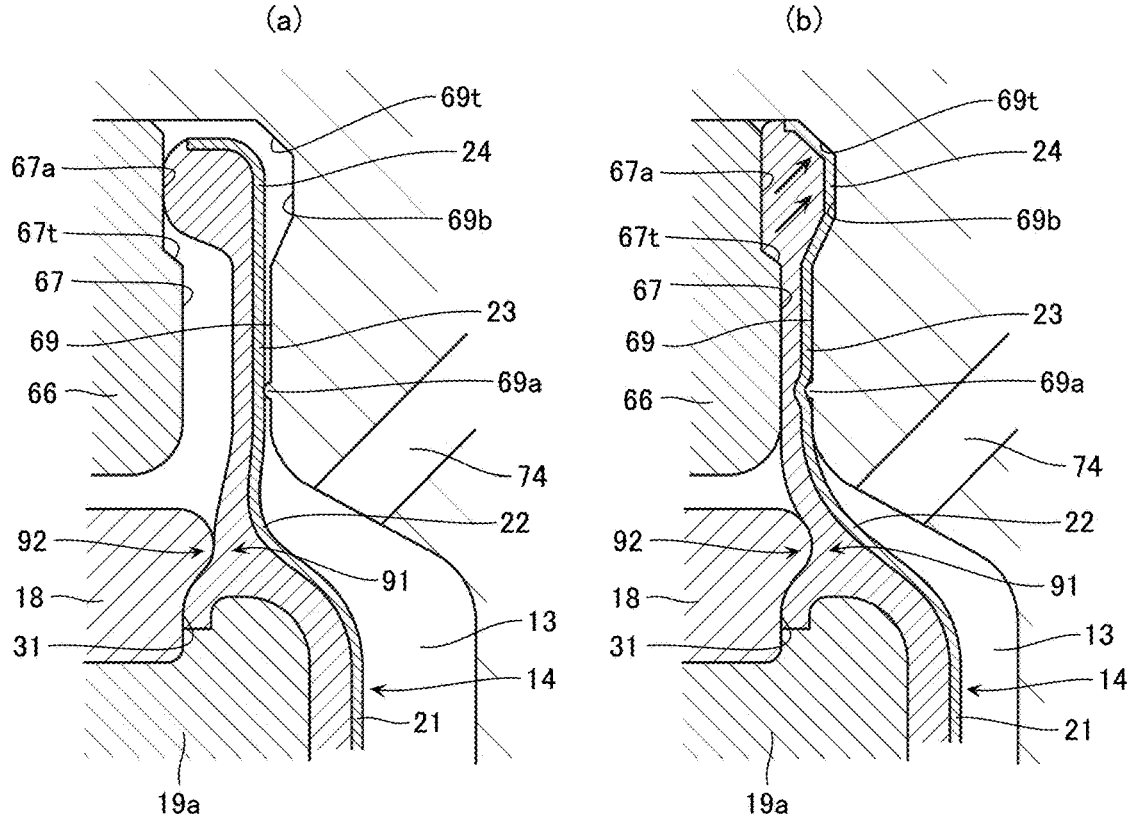
FIG. 4 is a partial enlarged cross-sectional view of the diaphragm and the retainer.

FIG. 1 is a perspective view showing an exterior configuration of a pump device to which a mounting structure for a diaphragm and a retainer of an embodiment of the present invention is applied. FIG. 2 is a cross-sectional view taken at the line A-A in FIG. 1. FIG. 3 is a cross-sectional view taken at the line B-B in FIG. 2. FIG. 4 is a partial enlarged cross-sectional view of the diaphragm and the retainer. FIG. 4(*a*) shows the diaphragm and the retainer just before being attached to the pump device. FIG. 4(*b*) shows the same after being attached.

As shown in FIG. 1, a pump device 100 includes a pump head 10 and a device main body part 50 to which the pump head 10 is detachably attached.

The pump head 10 is structured with a molded resin product, for example. The device main body part 50 includes a resin casing, for example, and has, on a side of one of the lateral surfaces (the right lateral surface in FIG. 1), a head attachment part 51 having a recessed shape formed by removing parts of the top surface, the side surface, and the rear surface. The pump head 10 is attached to the head attachment part 51 in such a manner that the top surface, the side surface, and the rear surface thereof do not jut out from the device main body part 50. As explained herein, the pump head 10 is formed to have dimensions in such a range that, when being attached to the head attachment part 51, the pump head 10 fits into and filling a space in the head attachment part 51 so that the pump device 100 has a rectangular shape as a whole.

The device main body part 50 includes, on the inside thereof, flexible diaphragms 14 (see FIG. 2) respectively attached to a plurality of pump chambers 13 (see FIG. 2) of the pump head 10, which will be explained later, in a liquid-tight manner and a plurality of actuators 110 (see FIG. 2) that reciprocate the diaphragms 14. In the present embodiment, two pump chambers 13 and two actuators 110 are provided, for example.

Further, the device main body part 50 includes: an operation panel part 53 having a display 52 and being provided on the front surface side; and external input/output ports 54 provided on the lateral surface opposite from the head attachment part 51 of the device main body part 50. In addition, on the inside of the device main body part 50, a control unit (not shown) that controls operations of the pump device 100 is provided. The display 52 displays various types of information related to the pump device 100 including a set flow rate of the pump device 100. For example, it is possible to set the set flow rate in a flow rate range of 100 ml/min to 0.01 ml/min.

Together with the display 52, the operation panel part 53 includes a power supply button 53*a*, a pump operation start/stop button 53*b*, and a cursor/return operation part 53*c*. Further, the operation panel part 53 includes a calibration button 53*d*, a mode setting button 53*e*, a range setting button 53*f*, a stroke setting button 53*g*, and an I/O setting button 53*h*.

With the cursor/return operation part 53*c*, a maximum volume designation button 53*ca* and an escape button 53*cb* are provided together. By carrying out various types of operation inputs via the operation panel part 53, a user of the pump device 100 is able to perform various types of operations related to the motion, the settings, and the like of the pump device 100.

As shown in FIG. 2 and FIG. 3, the pump head 10 includes a suction port 11 for the transport fluid being connected to a suction-side hose via a connection nut (not shown), a discharge port 12 for the transport fluid being connected to a discharge-side hose via a connection nut (not shown), and the plurality of pump chambers 13 communicating with the suction port 11 and the discharge port 12. The pump head 10 accommodates, on the inside thereof, a plurality of valve modules 20 arranged along a horizontal direction. Each of the valve modules 20 includes a suction valve 30 and a discharge valve 40 that are arranged along a vertical direction and are each structured with a ball valve, for example.

To the inside of the pump chambers 13 of the pump head 10, the transport fluid from a tank (not shown) is introduced via the suction-side hose, the suction port 11, and a pump chamber communication flow path 74. Further, from the pump chambers 13, the transport fluid therein is discharged to the outside via the pump chamber communication flow paths 74, the discharge port 12, and the discharge-side hose.

The pump head 10 includes a first block 15 and a second block 16 structuring a plurality of pump head blocks that can be separated in the vertical direction, between the suction valves 30 and the discharge valves 40 of the plurality of valve modules 20. The first block 15 includes a first suction-side flow path 71 extending horizontally and communicating with the suction port 11 formed in the lateral surface; and a plurality of second suction-side flow paths 72 each extending vertically upward and communicating with the first suction-side flow path 71.

A plurality of first accommodation chambers 73 that communicate with the second suction-side flow paths 72, open toward the top, and accommodate certain sections of the valve modules 20 positioned on the suction valves 30 side is formed in the first block 15. Further, diaphragm attachment bores 17 for forming the pump chambers 13 in collaboration with the diaphragms 14 are formed in the first block 15 so as to open toward a wall surface of the head attachment part 51 of the device main body part 50 in a direction intersecting the first and the second suction-side flow paths 71 and 72.

The diaphragm attachment bores 17 are provided in certain positions within the first block 15 so that an upper part of each of the pump chambers 13 is positioned below a plurality of side flow paths arranged at prescribed intervals in the circumferential direction of the corresponding valve module 20. The pump chamber communication flow paths 74 extend diagonally upward from the plurality of pump chambers 13, respectively, and communicate with the plurality of first accommodation chambers 73.

The second block 16 includes a first discharge-side flow path 81 extending horizontally and communicating with the discharge port 12 formed in the lateral surface; and a plurality of second discharge-side flow paths 82 each extending vertically downward and communicating with the first discharge-side flow path 81. A plurality of second accommodation chambers 83 that communicate with the second discharge-side flow paths 82, open toward the bottom, and accommodate certain sections of the valve modules 20 positioned on the discharge valves 40 side is formed in the second block 16. A circular truncated cone space 84 is formed above each of the second accommodation chambers 83 so that communication with the second discharge-side flow path 82 is allowed via the circular truncated cone space 84.

The first block 15 and the second block 16 structure the pump head 10, by being integrally formed through screw fastening using a plurality of fastening bolts 19 that extend vertically and serve as coupling means. When being integrally formed, the first block 15 and the second block 16 in the present embodiment have a rectangular shape such that the corner sections positioned on the operation panel part 53 side of the device main body part 50 are each chamfered. The pump head 10 structured in this manner is integrally attached to the lateral surface side of the device main body part 50, through screw fastening using a plurality of attachment screws (not shown) so as to be attached, via attachment bores 15*a*, to the head attachment part 51 of the device main body part 50.

As shown in FIG. 2, the actuators 110 are each an electromagnetic actuator, for example, and configured to be able to drive the plurality of diaphragms 14 individually in a phase shifted manner. Each of the actuators 110 includes an actuator main body part 111 having a circular cylindrical exterior shape. A control substrate (not shown) having an electrical wiring and a signal wiring (not shown) connected thereto is attached on the basal end side of the actuator main body part 111. The tip end side of the actuator main body part 111, which is the opposite side from the control substrate, is attached, by screw fastening or the like, for example, to an attachment panel 63 to be attached to an internal attachment part (not shown) of the device main body part 50.

To the actuator main body part 111 of each of the actuators 110, a movable shaft 112 is provided as a driving member that reciprocates in the axial direction (the reciprocation direction) to and from the pump chambers 13. The diaphragm 14 is attached to the tip end side of the movable shaft 112.

Each of the diaphragms 14 is structured with an elastic member of rubber, elastomer, or the like and includes, for example, a liquid contact part 14*a* made of fluoride resin or the like; and a bending/stretching part 14*b* made of rubber or the like. Each of the diaphragms 14 is formed to have a disc shape and includes: a fixation part 23 positioned in an outer circumferential part, a movable part 21 positioned in a central part, and a linking part 22 linking the fixation part 23 and the movable part 21 together. In the present example, the side of each of the diaphragms 14 facing the corresponding pump chamber 13 will be referred to as a front side, whereas the side opposite from the corresponding pump chamber 13 will be referred to as a rear side.

On the tip end side of the movable shaft 112, a retainer 18 having an annular shape is attached coaxially with the movable shaft 112. The retainer 18 holds the rear side of the movable part 21 of the diaphragm 14. Further, on the tip end side of the movable shaft 112, an insert bolt 19*a* serving as an insert member is fastened. The insert bolt 19*a* has a head part having an increased diameter and is integrally formed with the diaphragm 14 as a result of the head part being inserted in the movable part 21 of the diaphragm 14. The movable part 21 of the diaphragm 14 is sandwiched and held between the head part of the insert bolt 19*a* and the retainer 18. Accordingly, the movable part 21 of the diaphragm 14 is driven by the movable shaft 112 in the advancement/retreat direction (the reciprocation direction) to and from the corresponding pump chamber 13.

Further, between the attachment panel 63 to which the actuator 110 is attached and the first block 15 of the pump head 10, a bracket 66 having a circular cylindrical shape is attached. Attached to the inner circumferential side of the bracket 66 is a bush 65 which is for a water-proof purpose and has a circular cylindrical shape through which the movable shaft 112 is inserted. An outer circumferential part of the bracket 66 on the tip end side thereof is fitted into the diaphragm attachment bore 17 formed in the first block 15 of the pump head 10. The fixation part 23 positioned in the outer circumferential part of the diaphragm 14 is sandwiched and held in the reciprocation direction (the axial direction) between a first sandwiching surface 69 at a bottom part of the diaphragm attachment bore 17 formed in the first block 15 and a second sandwiching surface 67 at a front end part of the bracket 66. In this manner, the diaphragm 14 is fixed between the bracket 66 and the first block 15 of the pump head 10 in a liquid-tight manner, while the front side thereof forms the pump chamber 13 in collaboration with the first block 15 of the pump head 10.

Of the diaphragm 14, the front side of the movable part 21 protrudes more toward the pump chamber 13, relative to the front side of the fixation part 23. As shown in FIG. 4(*b*) in detail, on the rear side of a boundary section (or a boundary vicinity section) between the movable part 21 and the linking part 22, the diaphragm 14 has a first R-shaped part 91 recessed toward the pump chamber 13. The first R-shaped part 91 is provided over the entire circumference in the circumferential direction, for example, while spreading, in the radial direction, from a section of the movable part 21 on the outer circumferential side, to a section of the linking part 22 on the inner circumferential side and while having a curved shape recessed toward the pump chamber 13.

Further, as described above, the retainer 18 is an annular-shaped molded resin member or metal member that supports the rear side of the movable part 21 of the diaphragm 14 and that reciprocates in the advancement/retreat direction to and from the pump chamber 13, together with the movable part 21. Accordingly, along with the reciprocation of the movable shaft 112, the retainer 18 reciprocates while holding the diaphragm 14.

The retainer 18 is formed so as to include: an abutment part 31 that abuts against the rear side (of the movable part 21) of the diaphragm 14; and a second R-shaped part 92 that is formed in an outer circumferential position of the abutment part 31 so as to protrude more toward the pump chamber 13 relative to the abutment part 31 and that mates with the first R-shaped part 91. For example, the second R-shaped part 92 is provided over the entire circumference in the circumferential direction, while having a curved shaped so as to protrude more toward the pump chamber 13 relative to the front surface of the abutment part 31. A part of the movable part 21 of the diaphragm 14 is sandwiched and held between an inner circumferential part of the second R-shaped part 92 and the abutment part 31 of the retainer 18 and a tip end part of the insert bolt 19*a*.

Further, as shown in FIG. 4, the diaphragm 14 is formed to further have, on an outer circumferential rim of the fixation part 23, a seal part 24 that is thicker than the inside of the outer circumferential rim and is elastically deformable. The seal part 24 is provided so as to protrude toward the bracket 66 while having a curved shape over the entire circumference in the circumferential direction. Further, provided in a part of the sandwiching surface 69 of the pump head 10 is a projection part 69*a* projecting toward the sandwiching surface 67 of the bracket 66. The projection part 69*a* has a role of keeping strain of the seal part 24 caused by being pressed from being transferred to the linking part 22 side.

Further, formed on the outer circumferential side of the sandwiching surface 67 of the bracket 66 is a pressing surface 67*a* (a second pressing surface) that is recessed from the sandwiching surface 67 via a tapered part 67*t*. Further, formed on the outer circumferential side of the sandwiching surface 69 of the pump head 10 is a pressing surface 69*b* (a first pressing surface) that is recessed from the sandwiching surface 69. In this situation, the pressing surface 67*a* and the pressing surface 69*b* oppose the reciprocation direction. Further, the pressing surface 69*b* is formed so that a longitudinal cross-section thereof exhibits a polygonal shape or a curved shape. With this configuration, in an assembly step of the diaphragm 14 depicted in FIG. 4(*a*) and continued in FIG. 4(*b*), the seal part 24 of the diaphragm 14 is pressed and held between the pressing surface 67*a* and the pressing surface 69*b*. Because the seal part 24 is sealed between the pressing surfaces 67*a* and 69*b* over a large contact area, a constant and stable level of seal force is maintained, without creep or the like being caused by a local load. Further, according to the present embodiment, because the pressing surface 69*b* is formed so that the longitudinal cross-section thereof exhibits a polygonal shape or a curved shape, while the outer rim part of the pressing surface 69*b* has the tapered part 69*t* formed therewith, the thick seal part 24 is deformed so as to be pressed against the tapered part 69*t* by pressure when internal pressure of the pump chamber 13 rises. In this manner, it is possible to realize a self-seal structure where the seal force increases as the pressure rises. In addition, because the pressing surface 67*a* is formed so as to be recessed from the sandwiching surface 67 via the tapered part 67*t*, when the seal part 24 is pressed, the seal part 24 is further pressed against the tapered part 69*t* formed at the outer rim part of the pressing surface 69*b*, by the tapered part 67*t* formed between the sandwiching surface 67 and the pressing surface 67*a* of the bracket 66. Consequently, it is possible to realize the structure capable of enhancing the seal force.

Operations of the Embodiment Example

Figure 5:
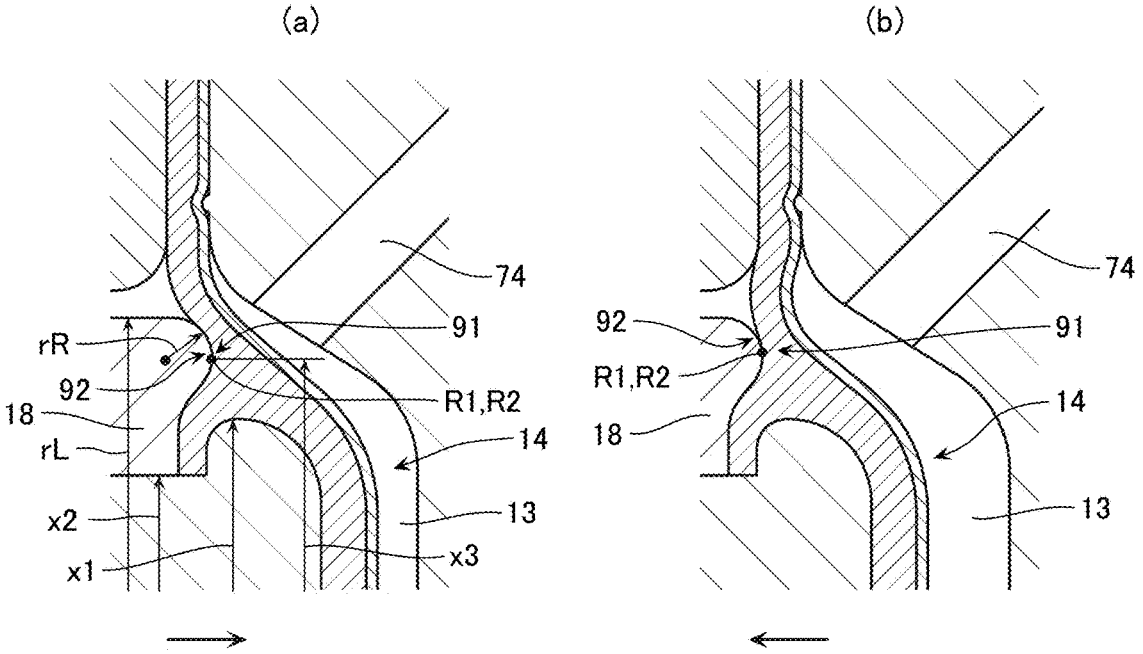
FIG. 5 is an enlarged longitudinal cross-sectional view for explaining states of the diaphragm and the retainer at a top dead center position and a bottom dead center position in a reciprocation direction.

FIG. 5 is an enlarged longitudinal cross-sectional view for explaining states of the diaphragm 14 and the retainer 18 of the pump device 100 at a top dead center position and a bottom dead center position in the reciprocation direction. FIG. 5(*a*) shows the state at the top dead center position, whereas FIG. 5(*b*) shows the state at the bottom dead center position.

The diaphragm 14 and the retainer 18 attached to the pump head 10 are attached in such a manner that at least sections of the first R-shaped part 91 and the second R-shaped part 92 that are positioned radially inward from apex parts R1 and R2 thereof are in contact with each other during the reciprocation of the diaphragm 14. In other words, the mounting is realized in such a manner that the sections of the R-shaped parts 91 and 92 that are positioned radially inward are constantly in contact with each other during the reciprocation from the top dead center position shown in FIG. 5(*a*) to the bottom dead center position shown in FIG. 5(*b*).

Further, the mounting is realized in such a manner that, when the movable part 21 of the diaphragm 14 has moved farthest toward the pump chamber 13 so as to be at the top dead center position for example, the apex part R2 of the second R-shaped part 92 of the retainer 18 is positioned closer to the pump chamber 13 relative to a surface (e.g., the second sandwiching surface 67) on the rear side of the fixation part 23 of the diaphragm 14. Also, the diaphragm 14 and the retainer 18 are attached in such a manner that, when the diaphragm 14 is in a neutral position between the top dead center position and the bottom dead center position for example, the first R-shaped part 91 and the second R-shaped part 92 are in contact with each other.

Further, the first R-shaped part 91 of the diaphragm 14 and the second R-shaped part 92 of the retainer 18 may each be formed so that a radius rR thereof is equal to or smaller than half a radius rL of the retainer 18. In addition, it is desirable when the radius rR of the second R-shaped part 92 is equal to or slightly smaller (within −10%) than the radius of the first R-shaped part 91. Furthermore, the abutment part 31 of the retainer 18 is formed, for example, as a flat surface positioned on the rear side of the movable part 21 of the diaphragm 14. In addition, a diameter x1 of the head part of the insert bolt 19*a* is formed, for example, so as to be equal to or larger than an inside diameter x2 of the abutment part 31 of the retainer 18 and so as to be equal to or smaller than a diameter x3 of the apex part R2 of the second R-shaped part 92.

As a result of attaching the diaphragm 14 and the retainer 18 with the relationship as described above, it is possible to realize a stable discharge amount of the pump device 100 and a prolonged life cycle of the diaphragm 14. To verify this effect, the present applicant performed various types of verification analyses through a simulation using the same material and the same dimensions, on the embodiment example in which the diaphragm 14 and the retainer 18 provided with the first and the second R-shaped parts 91 and 92 are attached while keeping the abovementioned relationship and on a comparison example to be compared which has no parts corresponding to the first and the second R-shaped parts 91 and 92.

Figure 6:
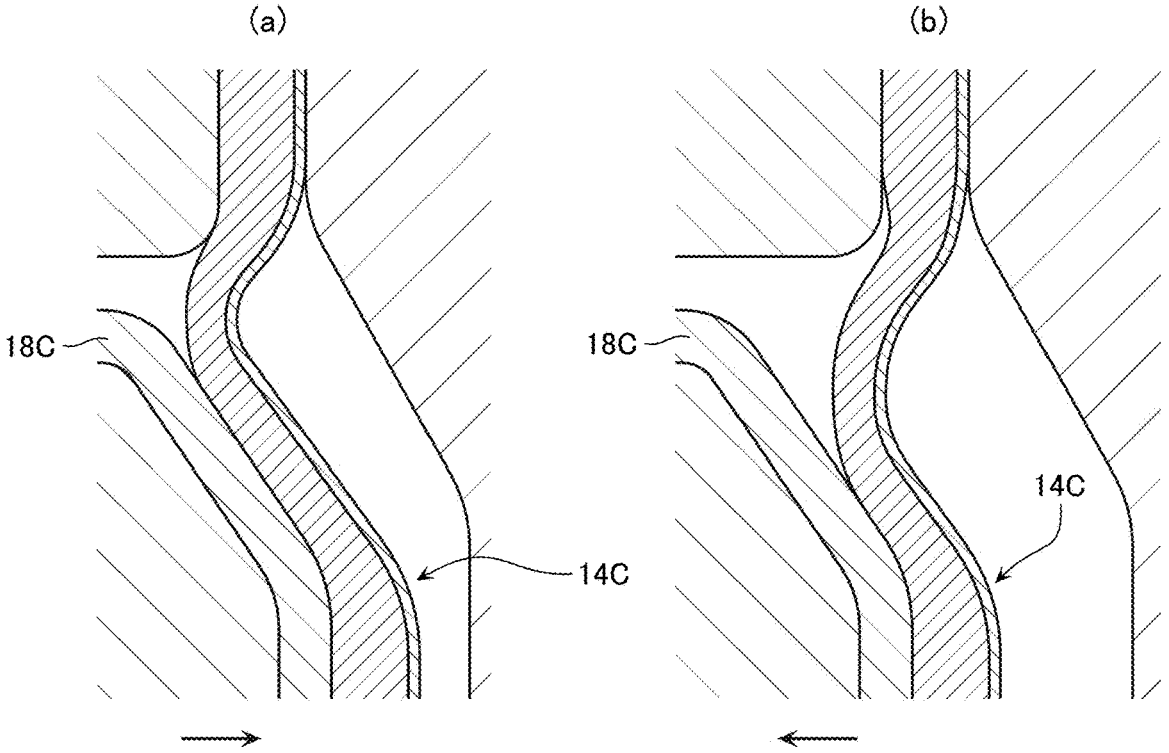
FIG. 6 is an enlarged cross-sectional view for explaining states of a diaphragm and a retainer in a comparison example at a top dead center position and a bottom dead center position in the reciprocation direction.

FIG. 6 is an enlarged cross-sectional view for explaining states of a diaphragm 14C and a retainer 18C in the comparison example at a top dead center position and a bottom dead center position in the reciprocation direction. FIG. 6(*a*) shows the state at the top dead center position, whereas FIG. 6(*b*) shows the state at the bottom dead center position. In FIG. 6, illustration of the configuration corresponding to the pump chamber communication flow paths 74 is omitted.

To begin with, effective diameters of the diaphragms 14 and 14C were verified. As previously explained, the effective diameter denotes a diameter defining the area of a part that presses the transport fluid and denotes, for example, a diameter defining the area of the part in which the diaphragm 14 (or 14C), together with the retainer 18 (or 18C), actually presses the transport fluid in the pump chamber 13.

At first, the effective diameters were confirmed from the volume that varies depending on the stroke, on the basis of analysis shapes of the diaphragms 14 and 14C at the bottom dead center position and analysis shapes of the diaphragms 14 and 14C at an arbitrary point on the way to the top dead center position. For both the embodiment example and the comparison example, an effective diameter in a no-load state was compared with an effective diameter observed when a pressure load of 1 MPa was applied to the diaphragm 14, 14C. In the comparison example, the effective diameter with no load having the analysis shape shown in FIG. 6(*a*), for instance, was 8.64 mm, whereas the effective diameter with the pressure load having the analysis shape shown in FIG. 6(*b*), for instance, was 5.36 mm. Consequently, the comparison example results indicated that the effective diameter was reduced by approximately 38% by the increase in the pressure.

In contrast, in the embodiment example, the effective diameter with no load having the analysis shape shown in FIG. 5(*a*), for instance, was 12.0 mm, whereas the effective diameter with the pressure load having the analysis shape shown in FIG. 5(*b*), for instance, was 10.48 mm. Consequently, the embodiment example results indicated that the effective diameter was reduced by approximately 13% by the increase in the pressure. From the above results, it became clear that the diaphragm 14 and the retainer 18 in the embodiment example were able to keep the reduction in the effective diameter approximately one-third of the reduction exhibited by the diaphragm 14C and the retainer 18C in the comparison example.

The above results indicated that, in the diaphragm 14C in the comparison example, as the applied pressure load became higher, because the strain escaped radially outward, deformation became more severe and the strain also increased. In contrast, in the diaphragm 14 of the embodiment example, it was indicated, even when the applied pressure load became higher, that the strain stayed near the areas radially inward of the first and the second R-shaped parts 91 and 92 and that the deformation did not easily occur. Consequently, by using the diaphragm 14 and the retainer 18 of the embodiment example, it is possible to keep extremely small the deformation of the diaphragm 14 that may be caused by the pressure load, in contrast to the comparison example. As a result, because there is a smaller difference in the effective diameter between the no-load state and the pressure-load state, it is appropriate to state that the stabilization of the discharge amount of the pump device 100 is achieved.

Figure 7:
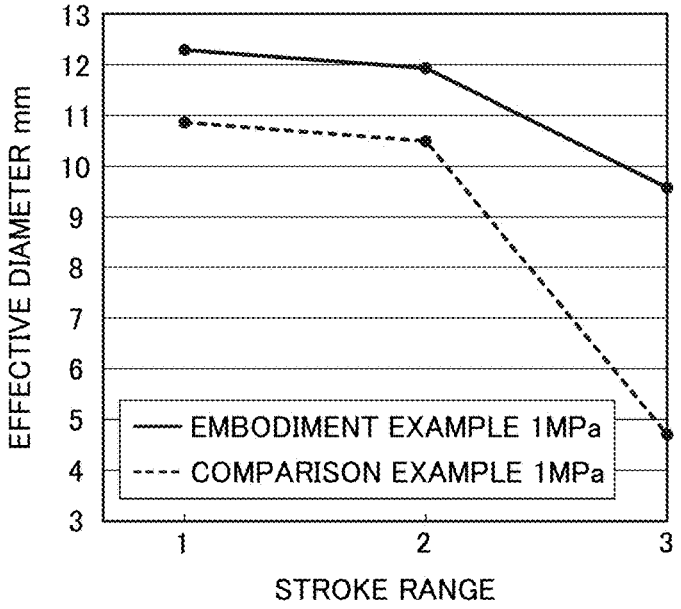
FIG. 7 is a chart showing analysis results of effective diameters corresponding to various reciprocation ranges of the diaphragm and the retainer, together with the comparison example.

FIG. 7 is a chart showing analysis results of effective diameters corresponding to various reciprocation ranges of the diaphragm 14 and the retainer 18, together with the comparison example. In FIG. 7, a pressure load of 1 MPa was applied both in the embodiment example shown with the solid line and in the comparison example shown with the broken line. In FIG. 7, the vertical axis expresses average effective diameters (mm), whereas the horizontal axis expresses stroke ranges using the top dead center position and the bottom dead center position as maximum points. In the present example, stroke range 1 denotes the range from 100% to 75%; stroke range 2 denotes the range from 75% to 25%; and stroke range 3 denotes the range from 25% to 0%.

As shown in FIG. 7, in stroke range 1, the embodiment example exhibited an average effective diameter of $12.2 mm, whereas the comparison example exhibited an average effective diameter of $10.9 mm. In stroke range 2, the embodiment example exhibited an average effective diameter of $11.9 mm, whereas the comparison example exhibited an average effective diameter of $10.6 mm.

In stroke range 3, the embodiment example exhibited an average effective diameter of $9.6 mm, whereas the comparison example exhibited an average effective diameter of $4.7 mm. As a result of comparing the effective diameters between the embodiment example and the comparison example in this manner, with respect to each of stroke ranges 1, 2, and 3, it became clear that the structure of the embodiment example evidently exhibited smaller changes in the average effective diameter as compared to the comparison example. The embodiment example uses the structure in which, the certain part of the second R-shaped part 92 of the retainer 18 that is positioned radially inward from the apex part R2 is constantly in contact with the certain part of the first R-shaped part 91 of the diaphragm 14 that is positioned radially inward from the apex part R1, so that the contact range changes only in the parts positioned radially more outward relative to the apex parts R1 and R2. It is therefore that there was a smaller difference in the contact area between the top dead center position and the bottom dead center position, and the strain was also smaller.

Figure 8:
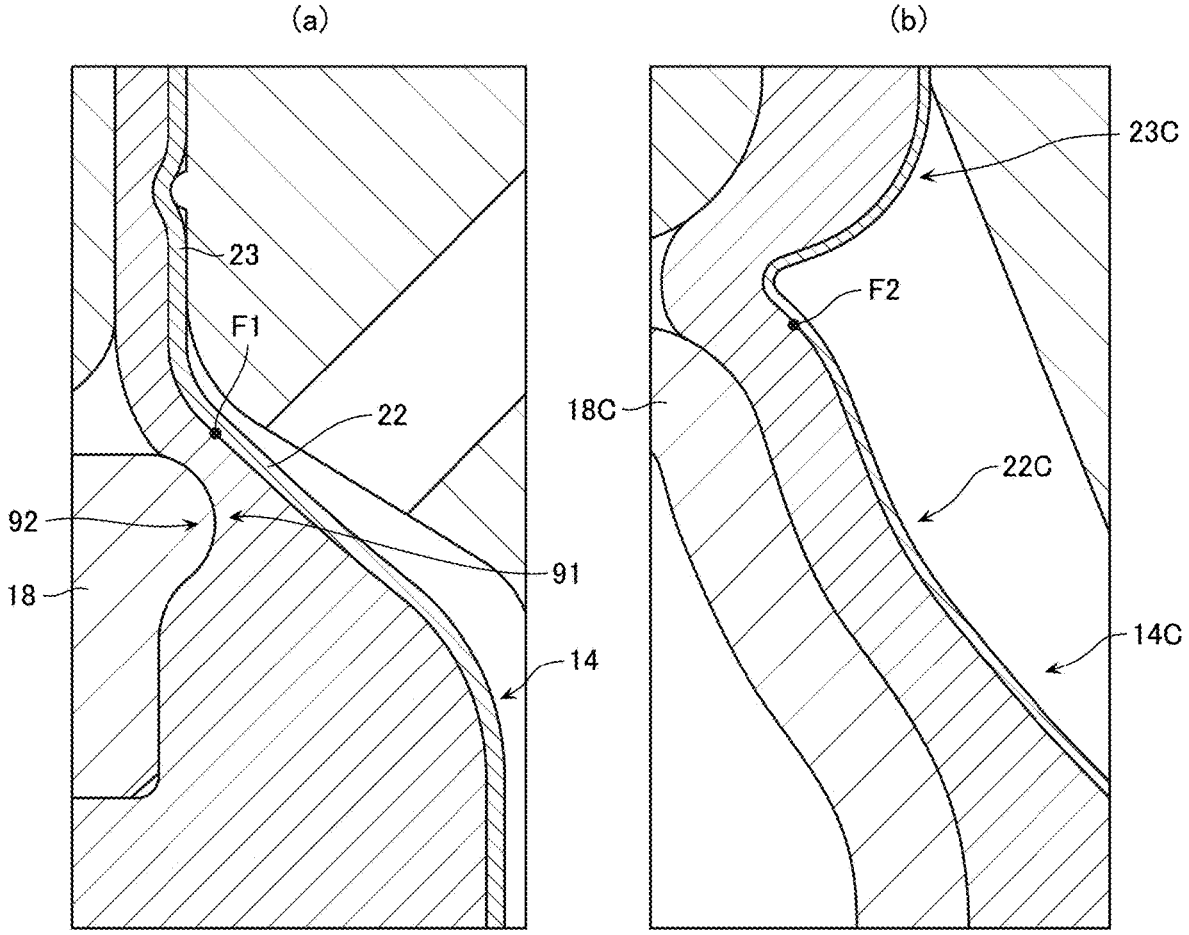
FIG. 8 is an enlarged cross-sectional view for explaining states of the diaphragm and the retainer at the top dead center position in the reciprocation direction, together with the comparison example.

FIG. 8 is an enlarged cross-sectional view for explaining states of the diaphragm 14 and the retainer 18 at the top dead center position in the reciprocation direction, together with the comparison example. FIG. 8(*a*) shows the embodiment example, whereas FIG. 8(*b*) shows the comparison example. In FIG. 8(*b*), illustration of the configuration corresponding to the pump chamber communication flow paths 74 is omitted.

As shown in FIG. 8(*a*), at the top dead center position, the diaphragm 14 and the retainer 18 of the embodiment example exhibited an equivalent strain of approximately 31.0% as analyzed at a strain point F1. In contrast, at the top dead center position, the diaphragm 14C and the retainer 18C of the comparison example exhibited an equivalent strain of approximately 69.4% as analyzed at a strain point F2. Consequently, it was understood that the structure of the embodiment example reduced the equivalent strain by approximately 558, as compared to the structure of the comparison example.

As described above, when the diaphragm 14 and the retainer 18 of the embodiment example were used, due to the first and the second R-shaped parts 91 and 92, because the strain was less easily transferred from the linking part 22 to the fixation part 23, stress concentration did not easily occur. On the contrary, it became clear that, when the diaphragm 14C and the retainer 18C of the comparison example were used, because the strain propagated from the linking part 22C to the fixation part 23C of the diaphragm 14C, stress concentration occurred. Consequently, because the diaphragm 14 and the retainer 18 of the embodiment example realize a structure that relaxes the stress concentration, the affected part does not easily become deteriorated and does not easily get damaged. It is therefore possible to realize a prolonged life cycle of the diaphragm 14.

As explained above, in the mounting structure for the diaphragm 14 and the retainer 18 according to the present embodiment, the diaphragm 14 and the retainer 18 are provided with the first R-shaped part 91 and the second R-shaped part 92 in the manner described above. Thus, it is possible to realize the structure in which the diaphragm 14 does not easily get deformed even when a pressure load is applied to the diaphragm 14 and to relax the stress concentration while preventing changes in the effective diameter. Consequently, it is possible to stabilize the discharge amount of the pump device 100 and to realize a prolonged life cycle of the diaphragm 14.

A number of embodiments of the present invention have thus been explained. However, these embodiments have been presented as examples and are not intended to limit the scope of the invention. It is possible to carry out these novel embodiments in other various modes and to make various omissions, substitutions, and changes without departing from the gist of the invention. For example, in the above embodiment, the example was explained in which the pump head 10 is provided on the lateral surface of the device main body part 50; however, the present disclosure is also applicable to a mounting structure for a diaphragm and a retainer used in a so-called upright pump device in which a pump head is provided in a top part of a device main body part. In that situation, because the actuators will be of an upright type, the diaphragms will be arranged horizontally. These embodiments and modifications thereof are included in the scope and the gist of the invention and are also covered by the inventions set forth in the claims and equivalents thereof.

REFERENCE SIGNS LIST

10: pump head
13: pump chamber
14: diaphragm
17: diaphragm attachment bore
18: retainer
19*a*: insert bolt
21: movable part
22: linking part
23: fixation part
24: seal part
31: abutment part
50: device main body part
66: bracket
67: sandwiching surface (second sandwiching surface)
67*a*: pressing surface (second pressing surface)
69: sandwiching surface (first sandwiching surface)
69*b*: pressing surface (first pressing surface)
91: first R-shaped part
92: second R-shaped part
100: pump device

The invention claimed is:

1. A mounting structure comprising:

a diaphragm that is formed to have a disc shape and includes a fixation part positioned in an outer circumferential part of the diaphragm, a movable part positioned in a central part of the diaphragm, and a linking part linking the fixation part and the movable part together, wherein a side of the diaphragm facing a pump chamber is defined as a front side and a side of the diaphragm opposite from the pump chamber is defined as a rear side;

a movable shaft that has an insert member attached at a tip end of the movable shaft and that drives the movable part to reciprocate in an axial direction while a tip end part of the insert member is inserted in the movable part of the diaphragm; and a retainer that has an annular shape, is attached to the tip end of the movable shaft coaxially with the movable shaft, supports the rear side of the movable part of the diaphragm, and reciprocates, together with the movable part, in an advancement/retreat direction to and from the pump chamber, wherein the diaphragm has a first curved part recessed toward the pump chamber and provided over an entire circumference of the diaphragm in the circumferential direction, on the rear side of a boundary section between the movable part and the linking part, the retainer includes an abutment part that abuts against the rear side of the diaphragm and a second curved part that is formed in an outer circumferential position of the abutment part so as to protrude farther toward the pump chamber than the abutment part and provided over an entire circumference of the retainer in the circumferential direction, and that mates with the first curved part, and a part of the movable part of the diaphragm is sandwiched and held between an inner circumferential part of the second curved part and the abutment part of the retainer and the tip end part of the insert member, and reciprocates in the axial direction together with the movable shaft.

2. The mounting structure for the diaphragm and the retainer according to claim 1, wherein when the movable part of the diaphragm moves farthest toward the pump chamber so as to be at a top dead center position, an apex part of the second curved part of the retainer is positioned closer to the pump chamber relative to a surface of the diaphragm on a rear side of the fixation part.

3. The mounting structure for the diaphragm and the retainer according to claim 2, wherein the diaphragm and the retainer are attached in such a manner that at least sections of the first curved part and the second curved part that are positioned radially inward from apex parts of the first curved part and the second curved part are in contact with each other during reciprocation of the diaphragm.

4. The mounting structure for the diaphragm and the retainer according to claim 2, wherein the pump chamber is provided in a pump head, the pump head has a first sandwiching surface on the diaphragm side, a bracket having a second sandwiching surface opposing the first sandwiching surface of the pump head is provided, the fixation part of the diaphragm is sandwiched and held between the first sandwiching surface of the pump head and the second sandwiching surface of the bracket, the diaphragm further has, on an outer circumferential rim of the fixation part, a seal part that is thicker than an inside of the outer circumferential rim and is elastically deformable, formed on an outer circumferential side of the first sandwiching surface of the pump head is a first pressing surface recessed from the first sandwiching surface, formed on an outer circumferential side of the second sandwiching surface of the bracket is a second pressing surface recessed from the second sandwiching surface, and the seal part is pressed and held between the first pressing surface and the second pressing surface.

5. The mounting structure for the diaphragm and the retainer according to claim 2, wherein the diaphragm and the retainer are attached in such a manner that, when the diaphragm either is in a neutral position between the top dead center position and a bottom dead center position or is closer to the top dead center position relative to the neutral position, the first curved part and the second curved part are in contact with each other.

6. The mounting structure for the diaphragm and the retainer according to claim 1, wherein the diaphragm and the retainer are attached in such a manner that at least sections of the first curved part and the second curved part that are positioned radially inward from apex parts of the first curved part and the second curved part are in contact with each other during reciprocation of the diaphragm.

7. The mounting structure for the diaphragm and the retainer according to claim 6, wherein the pump chamber is provided in a pump head, the pump head has a first sandwiching surface on the diaphragm side, a bracket having a second sandwiching surface opposing the first sandwiching surface of the pump head is provided, the fixation part of the diaphragm is sandwiched and held between the first sandwiching surface of the pump head and the second sandwiching surface of the bracket, the diaphragm further has, on an outer circumferential rim of the fixation part, a seal part that is thicker than an inside of the outer circumferential rim and is elastically deformable, formed on an outer circumferential side of the first sandwiching surface of the pump head is a first pressing surface recessed from the first sandwiching surface, formed on an outer circumferential side of the second sandwiching surface of the bracket is a second pressing surface recessed from the second sandwiching surface, and the seal part is pressed and held between the first pressing surface and the second pressing surface.

8. The mounting structure for the diaphragm and the retainer according to claim 6, wherein the diaphragm and the retainer are attached in such a manner that, when the diaphragm either is in a neutral position between the top dead center position and a bottom dead center position or is closer to the top dead center position relative to the neutral position, the first curved part and the second curved part are in contact with each other.

9. The mounting structure for the diaphragm and the retainer according to claim 1, wherein the pump chamber is provided in a pump head, the pump head has a first sandwiching surface on the diaphragm side, a bracket having a second sandwiching surface opposing the first sandwiching surface of the pump head is provided, the fixation part of the diaphragm is sandwiched and held between the first sandwiching surface of the pump head and the second sandwiching surface of the bracket, the diaphragm further has, on an outer circumferential rim of the fixation part, a seal part that is thicker than an inside of the outer circumferential rim and is elastically deformable, formed on an outer circumferential side of the first sandwiching surface of the pump head is a first pressing surface recessed from the first sandwiching surface, formed on an outer circumferential side of the second sandwiching surface of the bracket is a second pressing surface recessed from the second sandwiching surface, and the seal part is pressed and held between the first pressing surface and the second pressing surface.

10. The mounting structure for the diaphragm and the retainer according to claim 4, wherein the diaphragm and the retainer are attached in such a manner that, when the diaphragm either is in a neutral position between the top dead center position and a bottom dead center position or is closer to the top dead center position relative to the neutral position, the first curved part and the second curved part are in contact with each other.

11. The mounting structure for the diaphragm and the retainer according to claim 1, wherein the diaphragm and the retainer are attached in such a manner that, when the diaphragm either is in a neutral position between the top dead center position and a bottom dead center position or is closer to the top dead center position relative to the neutral position, the first curved part and the second curved part are in contact with each other.

12. The mounting structure for the diaphragm and the retainer according to claim 1, wherein a diameter of the tip end part of the insert member is equal to or larger than an inside diameter of the abutment part of the retainer and is equal to or smaller than a diameter of the apex part of the second curved part.

* * * * *